United States Patent [19]

Sweeny

[11] Patent Number: 4,707,202

[45] Date of Patent: Nov. 17, 1987

[54] TAPE APPLICATOR

[75] Inventor: Henry D. Sweeny, Kitchener, Canada

[73] Assignee: Swenco Limited, Waterloo, Canada

[21] Appl. No.: 841,965

[22] Filed: Mar. 20, 1986

[30] Foreign Application Priority Data

Jun. 28, 1985 [CA] Canada ..... 485809

[51] Int. Cl.[4] ..... B32B 31/00; B44C 7/02

[52] U.S. Cl. ..... 156/71; 156/250; 156/304.3; 156/523; 156/527; 156/577; 156/579

[58] Field of Search ..... 156/523, 524, 526, 527, 156/574, 575, 577, 579, 71, 250, 269, 304.3

[56] References Cited

U.S. PATENT DOCUMENTS

| | | | |
|---|---|---|---|
| 1,960,850 | 5/1934 | Lloyd | 156/526 |
| 2,235,704 | 3/1941 | Gorbatenko | 156/526 |
| 2,647,557 | 8/1953 | Selvin | 156/579 |
| 2,890,808 | 6/1959 | Seror | 156/577 |
| 3,537,941 | 11/1970 | Miklos | 156/577 |
| 4,196,028 | 4/1980 | Mills et al. | 156/71 |
| 4,208,239 | 6/1980 | Lass | 156/575 |
| 4,313,780 | 2/1982 | Ford, Jr. | 156/577 |
| 4,358,337 | 11/1982 | Johnson et al. | 156/575 |
| 4,406,730 | 9/1983 | Altmix | 156/579 |
| 4,452,663 | 6/1984 | Heaton | 156/575 |
| 4,490,206 | 12/1984 | Makley | 156/577 |
| 4,555,298 | 11/1985 | Boucher | 156/523 |

*Primary Examiner*—Michael Wityshyn

*Attorney, Agent, or Firm*—Jones, Tullar & Cooper

[57] ABSTRACT

The invention provides a device for applying tape from a roll thereof to a surface. In particular the device has utility for applying drywall tape to flat or corner joints formed by meeting sheets of drywall material. The device has a cast head and a handle attached to one end thereof, the head being adapted to releasably and rotatably mount a roll of tape therein. A roller assembly at the other end of the head includes frame members pivotally mounted to the head, with first and second applicator rollers rotatably mounted between the frame members. For flat joints the rollers are both cylindrical, and are at least as wide as the tape. For corner joints the first applicator roller is about half as wide as the tape and the second applicator roller has an inverted V-shaped profile for pushing the tape into the corner. As the device is moved along the corner tape fed from the roll is initially formed to have a transversely concave shape by the first applicator roller, contacting only the edges thereof, and is finally formed into a right angle by the second applicator roller. The roller assembly pivots relative to the head as the device is moved along the corner to keep the rollers in contact with the wall sections defining the corner. A cutting mechanism is provided for severing the applied tape from the tape roll when sufficient tape has been applied to the corner.

21 Claims, 22 Drawing Figures

TAPE APPLICATOR

This invention relates to tape applicators in general and to applicators for drywall joint tape in particular.

BACKGROUND TO THE INVENTION

In the construction industry drywall is almost universally used as the wall covering for interior walls and ceilings of buildings, particularly for residential housing. Drywall, also known as gypsum board, includes a central layer of hard gypsum covered on each side by a layer of heavy paper. In most types of drywall the longitudinal edges are somewhat rounded and the thickness of the sheet adjacent each edge is slightly reduced for about 5 cm from the edge. The thickness reduces gradually and the reduction takes place only on the interior surface of the sheet, that being the surface facing the interior of the room. When two sheets are butted edge to edge the adjacent reduced areas form a "groove" or joint which can be filled with a gypsum-based joint compound which, after it has set, can be sanded smooth to eliminate any effect of the joint. When the wall is painted, or covered with wallpaper or other covering, the wall will have the appearance of being continuous rather than being made up of a series of drywall panels, the width thereof being typically four feet.

Typically a drywall joint is filled in a number of steps, the first entailing the application of a layer of compound over the length of the joint. Then a strip of drywall tape, usually of paper, is applied to and embedded in the wet compound. The tape gives body to the joint and, when the edges of the sheet are not butting tight against each other, it bridges the gap between the edges and helps reduce the amount of compound required. Thereafter additional layers of compound are applied to the joint, over the tape, and they are of increasing width, being feathered outwardly to merge smoothly with the surfaces of the drywall sheets. Most of the compound, and the tape, will be located within the groove defined by the thinner edge regions of the drywall sheets, so that there is little or no outward bulging of the compound.

As an alternative to the paper tape, it is possible to use an open mesh tape which provides a screen-like texture to which the compound can readily adhere. Furthermore, it is possible to use tape having a pressure sensitive adhesive coating on one side so that the tape can be adhered directly to the mating surfaces of the drywall, thereby eliminating the initial application of joint compound. With the adhesive-backed tape the jointing of drywall sheets used on a ceiling is particularly enhanced since the wet compound has a good backing to which it can adhere and consequently there will be less dropping of compound from the ceiling to the floor.

When applying tape, whether plain paper, mesh or adhesive backed, it is necessary to take the tape from a roll and to apply it to a joint which may be as short as a few inches or as long as thirty or forty feet (if a long joint, say extending up a wall, across a ceiling and down another wall, has been created). The application of the tape can be very messy and at best it will be awkard over long distances. Furthermore, it is difficult to apply uniform pressure to the tape so that it is uniformly embedded in the joint compound, without air bubbles in the case of plain paper tape, and so that it is not wrinkled or straying excessively from the joint line. There is therefore a need for an applicator that the workman can easily manipulate for both ceiling and wall work and which has provisions for easy tape replacement and cutting. When used for ceiling joints the applicator should be designed so that the workman does not have to mount a stepladder to get close to the ceiling.

Another area in which problems exist is in the corners, both vertical and horizontal. First of all it is unlikely that sheets of drywall will meet at their edges in corners and hence the preformed edge groove is not available to receive the tape. Thus it is even more important that the tape lie flat against the surfaces of the drywall sheets. Secondly, when manually applying tape to corners one must first crease the tape longitudinally thereof to place it in a "V" shape so that it can be readily and reasonably accurately placed in the corner. Most tapes have a preformed crease line therein extending along the centerline thereof to facilitate the creasing or folding step. Lastly, an applicator tool, many of which have been tried, and have failed, commercially, which works well on wall joints between coplanar wall joints, is ineffective in applying drywall tape to a corner, whether the corner be vertical, as formed between abutting wall sheets, or horizontal, as formed between abutting wall and ceiling sheets.

SUMMARY OF THE INVENTION

The problems associated with the application of joint tape are overcome by the present invention which utilizes an integrally formed head member having a spring biased disc system to hold a tape roll within the head member, which system permits the rapid replacement of a spent roll with a new roll with a minimum of effort. A handle is attached to the head member at one end thereof and at the other end a frame or support is pivotally attached. The frame carries therein a rotatable first applicator roller and a rotatable second applicator roller. As the operator moves the applicator along the joint both rollers will remain in contact with the drywall due to the pivotting action of the frame relative to the head member. Tape is drawn from the roll by the first applicator roller and is applied to the joint by both applicator rollers.

When the operator has reached the bottom of the joint (on a vertical joint) the frame and the head member will be at an angle to each other. In order to cut the tape, a cutting system is provided which places a cutting knife or blade at the rotational limit position of the frame relative to the head member. This can be accomplished either by mounting the knife means directly to the frame so that it is always at a fixed position relative to the frame, or by pivotally mounting the knife means to the head member and by adjustably securing the knife means at a desired angular position so that at the end of the run the knife is properly positioned relative to the tape for the cutting step. The former configuration has the advantage that the knife is always correctly positioned no matter how tall the operator is or what the relative angle may be between the frame and the head member at the end of a run.

It will be noted that the preceeding discussion is not specific to a corner applicator. In fact the principles of the present invention could be used in a "second generation" applicator for flat joints. The principles of the present invention, however, are particularly suited to an applicator for placing tape in corners. For the corner situation the first applicator roller is relatively narrow, about ½ the width of the tape. As the tape is drawn from the roller over the first applicator roller it takes a concave shape, touching the first applicator roller only along its edges. The second applicator roller is closely adjacent the first applicator roller and has a "V"-shaped profile so as to present a single circumferential edge and side surfaces sloping radially away therefrom towards the axis of the roller. The angle of the "V" is 90° or slightly smaller. The preformed (concave) tape from the first applicator roller is engaged by the second applicator roller which further forms it into a "V"-shape and the second applicator roller forces the tape into the corner joint, the side surfaces of the second applicator roller serving to press the tape against the adjacent surfaces of the drywall sheets.

While the present invention will work with paper drywall tape which is embedded in an initial layer of joint compound, it works extremely well with pressure sensitive adhesive-coated mesh tape such as that sold under the trade mark "FIBATAPE".

Other forms and refinements of the invention, over and above the previously-described features, relate to the configuration of the head member, the tape cutting system and the aspect of interchangability of the roller supports for flat or corner work.

DESCRIPTION OF THE PREFERRED EMBODIMENT

Figure 1:
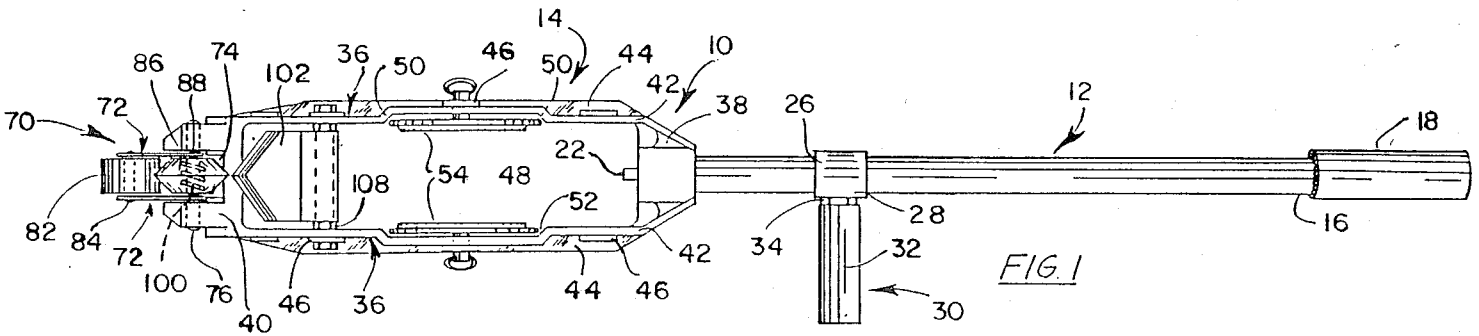
FIGS. 1 and 1A show plan and elevational views respectively of a first embodiment of the present invention.

The applicator of the present invention is shown by the reference number 10 and includes two main components, namely the handle 12 and the head 14. Each of these components will be described in greater detail below.

The handle 12 is cylindrical, elongated and of tubular material, such as extruded aluminum. At its free end the handle includes an angled portion 16 which is provided with a resilient grip 18 similar to a bicycle hand grip. In front of the grip 18, below the bend, there is a short slot 20 which communicates with the hollow interior of the handle. A rod 22, whose purpose will become apparent hereinafter, extends along the handle and exits through the slot 20 to terminate at a circular ring or trigger portion 24. The ring 24 may be covered by a resilient elastomeric material, such as neoprene tubing.

A collar 26 is provided for sliding and rotating movement on the main part of the handle 12. The collar 26 includes an enlarged portion 28 having a radially directed through bore. Within the bore and resting against the outer surface of the handle 12 is a brass plug or bearing member. A cylindrical auxiliary handle 30 has a resilient grip 32 thereon and has, as well, a threaded rod or bolt 34 projecting from one end for threaded reception in the bore of collar 26. When the auxiliary handle 30 is rotated to engage the rod 34 with the bore, the end of the rod 34 will press against the plug in the bore to force it against the handle 12, and to pull the collar so that the other side thereof also bears against the handle 12. By loosening the auxiliary handle 30, the collar can be slid or rotated on the handle for positioning in any desired location to provide comfort and improve ease of use for the person using the applicator.

The head 14 is attached to the handle 12 at the end thereof opposite the angled portion. Preferably the body of the head 14 is a unitary aluminum casting, including a pair of sides 36,36 and end sections 38,40 interconnecting the sides.

As illustrated in the drawings each side 36 includes a wall portion 42 having inner and outer surfaces and a flange 44 projecting outwardly from the outer surface at the bottom thereof. Each wall angles outwardly from the end section 38 and then runs parallel to the other wall for the remainder of the head's length. Spaced apart along each wall are reinforcements 46 which extend upwardly from flange 44 adjacent the outer wall surface. Since the head body is a casting, the reinforcements 46 will be unitary with the rest of the head body.

As indicated above the sides 36,36 are separated by end sections 38,40, the end sections and the sides defining a generally rectangular opening 48 through which the body of a full roll of tape can project. While the side wall portions 42 may be straight over the length of the head member it is preferred that they be offset as shown at 50 to define a recess 52 in which the tape roll-holding disc members 54 reside.

Figure 5:
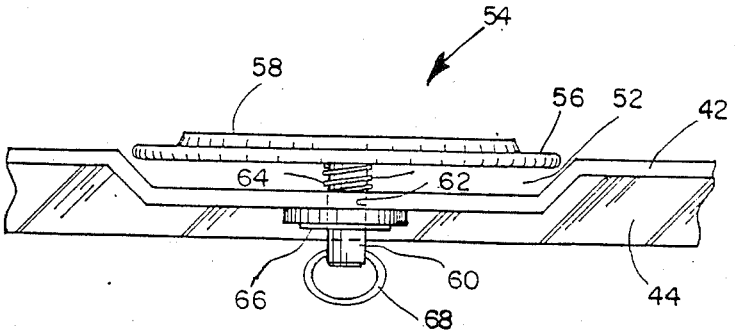
FIG. 5 is an enlarged partial plan view of the tape roll mounting disc and its assembly to a side wall.

Disc members 54 are provided to hold a roll of tape within the head member. Each member 54 includes an outer, large diameter portion 56 (see FIG. 5) having a diameter greater than that of the core of a roll of drywall tape. On its inner surface the portion 56 includes a raised circular portion 58 having a diameter essentially equal to the inner diameter of the core of a tape roll such that the roll can be positively located on the disc by the raised portion 58 in cooperation with the outer portion 56. A stub shaft 60 projects axially from the back of the outer portion 56 and is journaled in a bore 62 which passes through the side wall 42 and the central reinforcement 46. A compression spring 64 is located on the stub shaft 60 between the back of the disc member 54 and the inner surface of the side wall 42 so as to bias the disc member inwardly of the head. Each of the stub shafts has a circular groove (not shown) therein for reception of a removable circlip 66 whereby the stub shafts 60 may be removed from the head. One of the stub shafts is longer than the other so that it may be fitted with a removable pull ring 68. Each shaft 60 may be provided with an axially spaced series of circlip-receiving grooves so that the spacing of the disc members from their respective side walls and from each other can be adjusted to accommodate tape rolls of different widths.

Figure 1A:
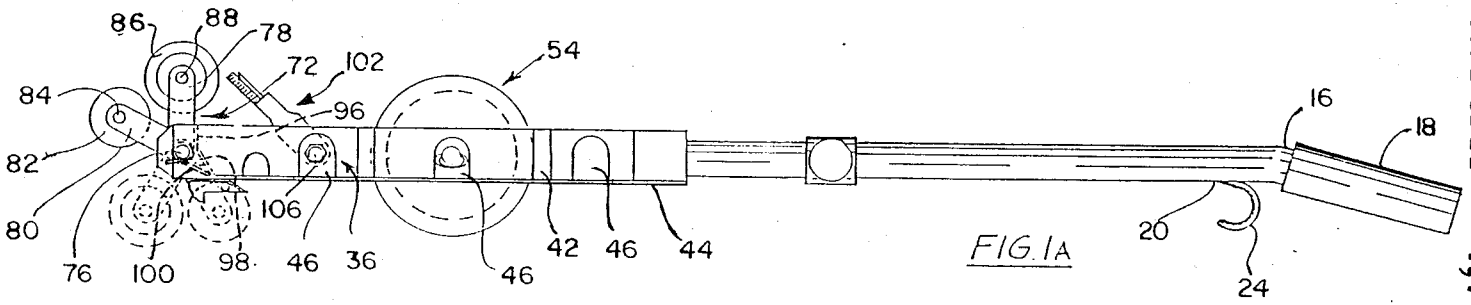

With reference now to FIGS. 1, and 1A the roller assembly used to place the tape in a corner will be described. The assembly 70 includes a pair of V-shaped frame members 72 which are located in a recess 74 in end mounting section 40 of the head 14. A pivot pin 76 extends through the walls of the recess and the apex area of the frame members 72 so as to pivotally mount the frame members to the head 14. If desired, a sleeve (not shown) may be secured to each frame member to join them together, the pin 76 passing through the sleeve to mount the joined frame members to the head 14.

Each frame member includes an upper leg 78 and a lower leg 80. A first applicator roller 82 is rotatably journaled on a shaft 84 which extends between the free ends of the lower legs 80 while a second applicator roller 86 is journaled on a shaft 88 extending between the free ends of the upper legs 78. Both rollers are preferably formed from a resilient, yet hard wearing material such as hard rubber.

The first applicator roller 82 is cylindrical and has a width which is approximately ½ the width of the tape to be used with the device. The second applicator roller 86 is about equal to the roller 82 in width but is of slightly larger diameter. Furthermore the second applicator roller has a V-shaped profile defined by sloping surfaces 90,92 (see FIG. 9) meeting at a sharp apex 94 which provides a sharp circumferential edge. The cone angle between the surfaces 90,92 is about 90° although it is preferable that the tolerance with respect to the angle be on the negative side.

As shown in FIG. 1A by comparing the solid and dotted-line positions of the assembly 70, the assembly 70 comprising the frame members 72 and the rollers 82,86 can pivot on the pin 76 between upper and lower limit positions defined by edges 96,98 within the recess. In operation of the device of this invention the lower limit position (dotted-lines) will correspond to a raised attitude of the device with the rollers adjacent the ceiling while the upper limit position (full lines) will correspond to a lowered attitude of the device with the rollers adjacent the floor. A torsional spring 100 wound on the pin 76 with one end connected to the frame assembly 70 and the other end connected to the head 14 will bias the frame assembly to the lower limit position for reasons to be discussed hereinbelow. Essentially, the spring 100 will return the frame assembly to the lower limit position whereby it is possible to commence applying tape from the ceiling to the floor again, without manually moving the frame assembly.

Once the tape has been applied to the drywall panels it is necessary to cut the tape so that another joint can be taped. Two alternative cutting arrangements are disclosed for this embodiment of the invention, both of which are effective, although the second embodiment is preferred.

The first cutter embodiment 102 shown in FIGS. 1, 1A, 4 and 4A includes a plate member 104 which is pivotally mounted to the head 14 between the side walls 36 by a shaft 106. Nuts 108, preferably wingnuts, are threaded to the shaft 106 so that when they are tightened they will lock the shaft 106 and the plate 104 at any desired angular orientation.

Figure 4:
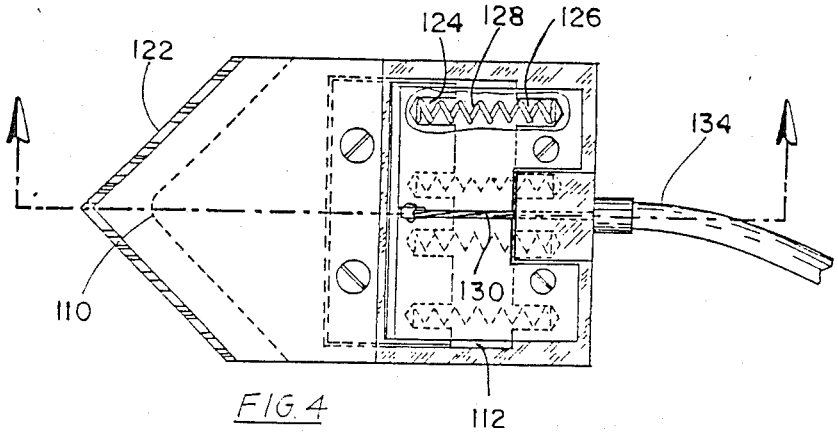
FIGS. 4 and 4A show plan and cross-sectional views respectively of a tape cutting system utilizable with the first or second embodiments.
Figure 4A:
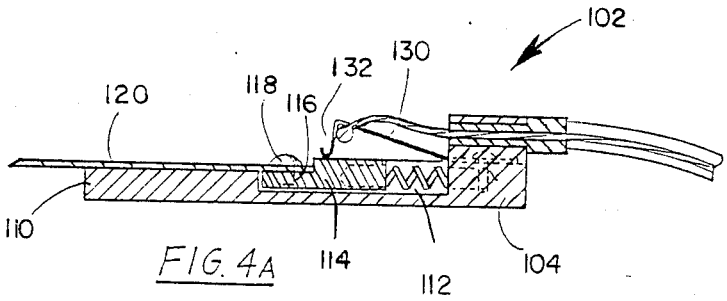

The plate 104 has its outwardly facing end shaped as in FIGS. 1 and 4 in a sharp point 110 having a 90° contained angle corresponding to the ideal corner defined by meeting drywall sections. The plate includes a recess 112 in its upper surface, the recess containing a rectangular carrier 114 which has a forward facing reduced thickness portion 116 to which is attached, by cap screws 118, a replaceable knife blade member 120. The knife blade has a sharpened forward edge 122 which also comes to a sharp point, containing a 90° angle.

A plurality of bores 124 is provided in the carrier 114 extending inwardly from the back face thereof, and a corresponding plurality of bores 126 is provided in the rear section of the plate 104 extending inwardly from the front face thereof. A compression spring 128 extends from each bore 126 into the aligned corresponding bore 124, the combined effect of the springs 128 serving to bias the carrier 114, and hence the knife blade member 120, forwardly. In its forward or cutting position of FIGS. 4, 4A, the cutting edge of the blade member extends beyond the forward edge of the plate 104 and while in its rearward or retracted position the blade is behind the forward edge of the plate 104.

A spring latch member 130 is secured to the plate 104 so that its forward detent 132 can latch the carrier 114 in a retracted position. A trigger cable 134, such as a Bowden cable, is attached at one end to the latch member 130 and at its other end to the rod 22 or trigger 24 so that when the trigger 24 is pulled the latch member 130 will be released, whereby the springs 128 will drive it forward to its cutting position.

Figure 2:
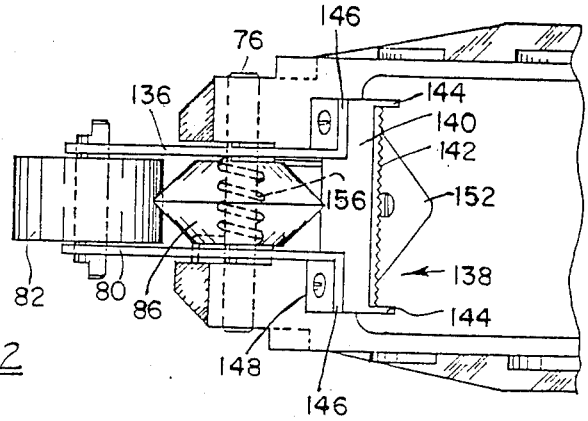
FIGS. 2 and 2A show plan and elevational views respectively of a second embodiment of the present invention.
Figure 2A:
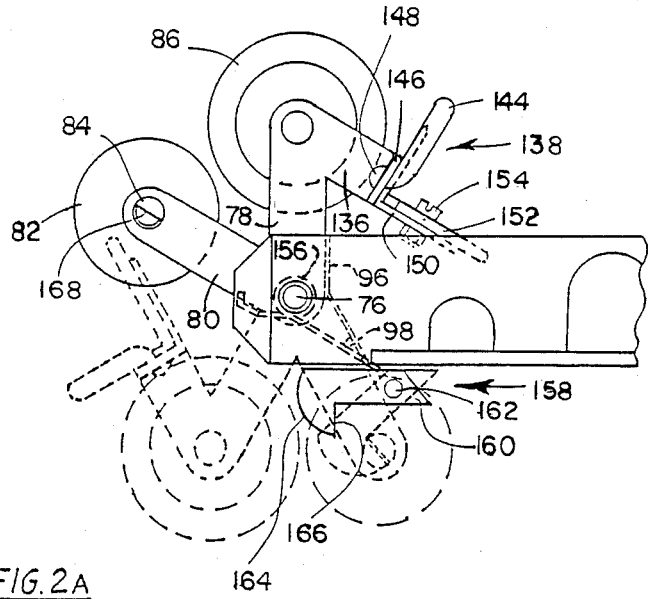
Figure 6:
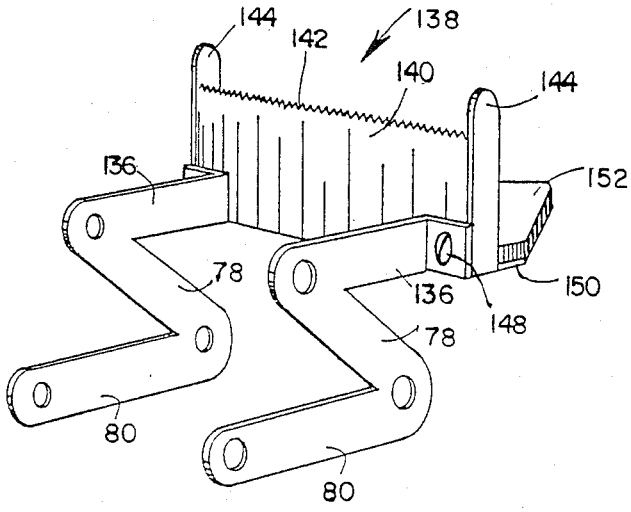
FIG. 6 is an enlarged view of the structure by which the pivotable roller supporting frame is mounted to the head member.

The second embodiment is shown in FIGS. 2, 2A and 6. In this embodiment each frame member has an N shape with another leg 136 extending parallel to the leg 80 from the free end of leg 78. The cutting mechanism 138 extends between the free ends of legs 136 and includes a blade member 140 having a serrated cutting edge 142 and side guide edges 144 which project beyond the cutting edge. The blade member 140 is attached to outwardly extending flanges 146 of legs 136 by way of machine screws 148.

Also attached to the blade member is a flange 150 projecting away therefrom at a 90° angle.

The flange 150 carries a hard rubber guide member 152 which, as seen in FIG. 2, has edges defining a 90° angle therebetween. The member 152 may be attached to the flange via cap screws 154.

The frame assembly of FIGS. 2, 2A is also spring-biased to the lower limit position by a torsion spring 156. However, it is locked in the lower limit position by a latch mechanism 158 which includes a cam member 160 pivoted to the underside of the head as at 162. The cam member includes a cam face 164 and a straight latch face 166, while the pin 84 has an extension with a flat 168 machined therein. As the frame assembly pivots to the lower limit position under the influence of spring 156 the pin extension will strike the cam face 164 to move the cam "upwardly" towards the head, and when the frame assembly has reached the lower limit position the cam will return to its rest position with the latch face 166 thereof engaging the flat 168 and thereby preventing the frame assembly from moving from its lower limit position. Preferably, the cam member 160 will be spring-biased away from the head, member in any conventional manner, as by a torsion spring on its pivot pin or a compression spring positioned between the cam member and the head, so that the camming action of the free assembly pin extension works against the cam member's spring bias to ensure that the cam member will return to its rest position when the flat 168 is ready to be engaged by the latch face 166. The cam member 160 will be connected to the rod 22 or trigger 24 by a suitable means such as a Bowden cable so that when the trigger 24 is pulled the frame assembly will be released from the latch mechanism 158.

OPERATION

Figure 7:
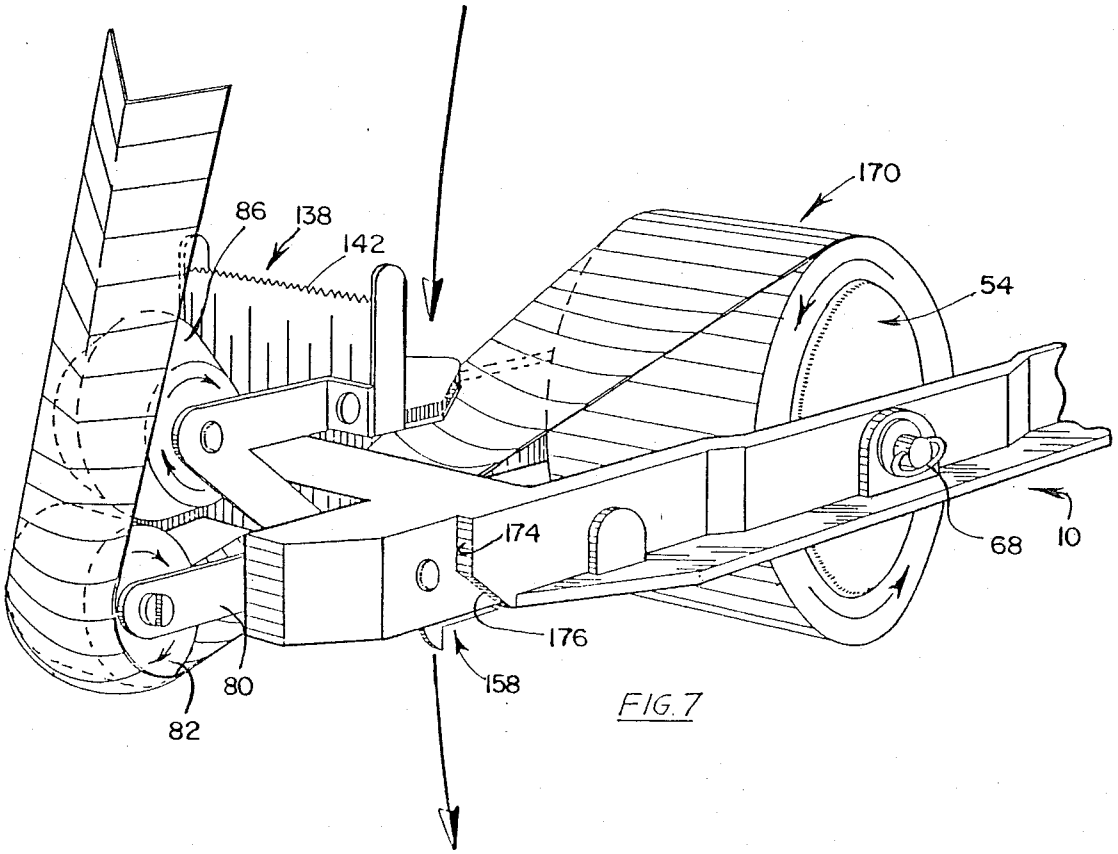
FIG. 7 is a perspective view of the applicator of this invention showing a roll of drywall tape therein.

The operation of the drywall tape applicators discussed above will now be described with reference to FIGS. 7 to 9.

The first step in using the tape applicator of this invention involves positioning a roll of tape in the device. This is accomplished by spreading the disc members 54, as by pulling on the ring 68 against spring 64 to move at least one member away from the other. A roll of tape 170 may then be placed between the disc members and the spring 64 released to clamp the roll between the disc members. The raised portions 58 on the discs will engage the center of the roll's core to positively locate the tape roll in the device. Assuming that an adhesive coated mesh tape is to be used the roll will be oriented so that the adhesive side will be exposed to the drywall.

Figure 8:
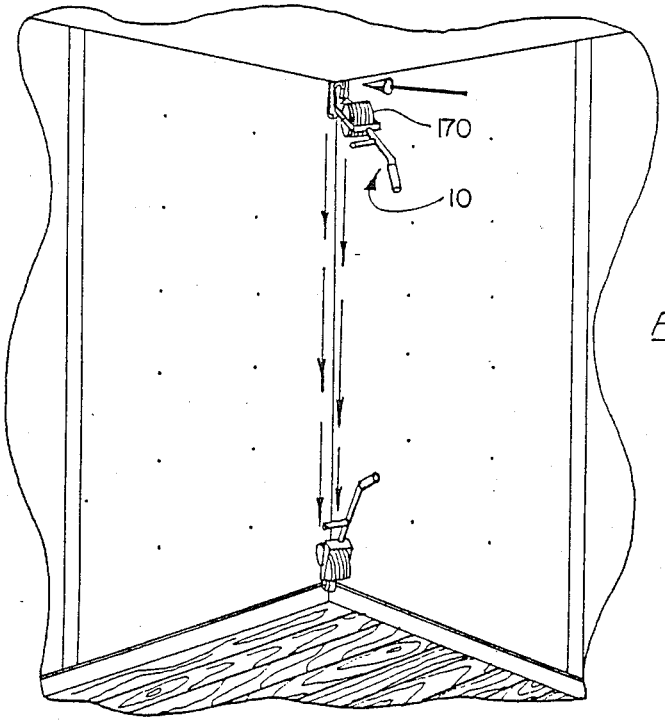
FIG. 8 shows schematically the use of the applicator of the present invention in a vertical corner.
Figure 9:
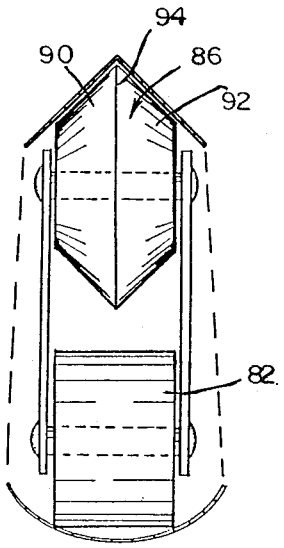
FIG. 9 shows the manner in which the tape is formed by the first and second applicator rollers respectively.

With the applicator of this invention, operation thereof will start at a ceiling and move downwardly to the floor in a smooth stroke, as in FIG. 8. Before starting to apply the tape, however, it is necessary to ensure that the frame assembly 70 is in the lower limit position, which it should be due to the bias of the torsion spring 100 or 156. A length of tape is drawn from the roll, pulled around the first applicator roller and the second applicator roller and snagged on the serrated edge 142 of the blade member 140 in the case of the FIG. 2 embodiment, or on the pointed edge 110 of the plate 104 in the case of the FIG. 1 embodiment. In either case the tape will take the configuration shown in FIG. 9, wherein the tape assumes a transversely curved attitude across the frist applicator roller 82, touching it only at the edges, and a generally V-shaped across the second applicator roller 86.

With the tape extended around the two rollers the first applicator roller is pushed into the vertical corner near the ceiling to cause the tape to adhere to the meeting wall sections along lines defined by the outer circumference edges of the first application roller. The V-shape of the second applicator roller stretches the tape into the corner and applies pressure to the tape to make it adhere completely to the walls. Then the operator moves the device downwardly along the corner as in FIG. 8, with an inwardly directed force applied thereto, so that as the tape is drawn from the roll it will be applied to the walls in its preformed V-shape, achieved by the first and second applicator rollers working together. As the device is moved vertically downwardly the roller frame assembly will pivot on pin 76 from the lower limit position to the upper limit position against the bias of spring 100 or 156.

When the device is at the bottom of the corner it will be necessary to cut the tape. With the embodiment of FIG. 1, the device will be held with the second applicator roller pressed into the corner while trigger 24 is pulled to release latch 130 of cutting mechanism 102. The knife 120 will be driven forwardly by springs 128 so that the cutting edge 122 will sever the tape as it contacts the tape. The cutting edge may drive a short distance into the walls but this is no problem since the tape, and any cuts in the wall, will be covered by drywall compound. After cocking the cutting mechanism and snagging the tape thereon the device is ready to be used again, the roller frame assembly having been returned to the lower limit position by spring 100.

With the embodiment of FIG. 2 the roller frame assembly will automatically be pivoted back to the lower position by the spring 156 after the bottom of the corner has been reached and the operator has withdrawn the device slightly from the wall and lifted it slightly to permit the spring 156 to return the frame assembly to that lower limit position. The latch mechanism 158 will lock the frame assembly in that lower limit position as previously described, with the serrated edge 142 pointing generally towards the floor and towards the length of tape bridging the gap from the wall to the applicator. The operator then applies a sharp downward push on the applicator device so that the serrated edge 142 will cut the tape, leaving a short length loose at the bottom of the wall, which length can be pushed into the corner by the V-shaped rubber guide 152. The severed end from the tape roll will be automatically snagged by the serrated edge 142 so that the operator is then ready to start another corner. When the next corner is to be taped the operator can push the second applicator roller into that corner near the ceiling, release the latch mechanism 158 by the trigger 24 to permit pivoting action of the frame assembly, and draw the applicator device down the corner to apply the tape as previously described.

The device of this invention can also be used for applying tape to horizontal corners, as between a ceiling and a vertical wall. The operation of either embodiment would be the same as described, running from one end of the horizontal corner to the other end thereof.

With the present invention the tape might not be applied exactly from one extreme end of a corner joint to the other extreme end but the shortfall will be so small as to be immaterial. In any locations where the tape has not been completely pressed against the walls, as at the extreme ends, or as in the case of imperfect corners, the person applying the drywall compound can easily smooth the tape into the corner, against the walls, with his trowel.

ALTERNATIVES

Figure 3:
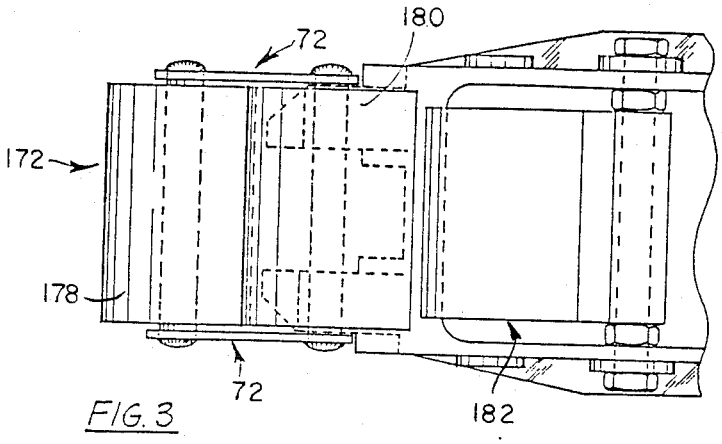
FIGS. 3 and 3A show partial plan and elevational views respectively of a third embodiment of the present invention.
Figure 3A:
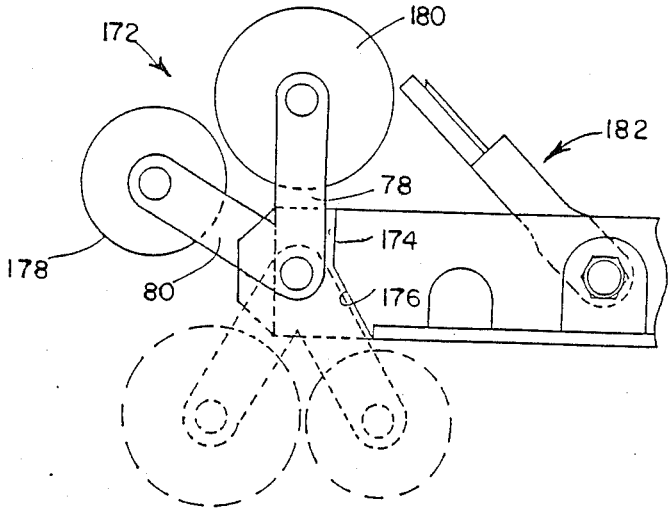

FIGS. 3 and 3A show one alternative embodiment of the present invention which allows the use of an analogous device for the application of tape to a smooth straight joint. In fact, the same head could be used for both straight and corner joints by merely interchanging one roller assembly and one cutting assembly for another roller assembly and another cutting assembly.

In FIGS. 3 and 3A a new roller assembly 172 is shown using the previous frame members 72,72 but with those frame members pivotally attached to the outer sides of the end mounting section rather than to the inner sides defining the recess 74. Flat edges 174, 176 define the upper and lower limit positions in the same manner as the flat edges 96, 98 within the recess 74. Straight cylindrical applicator rollers 178, 180 extend between the free ends of the frame members to engage the tape and to apply it to the wall joint as the device is moved along the joint.

The knife or cutting mechanism 182 of FIGS. 3, 3A is analogous to the mechanism 102 of FIGS. 1, 1A with the exception that the knife edge and the underlying plate thereof are straight.

In the operation of this embodiment the tape will be flat against the applicator rollers and will not assume the curved or V-shaped configuration of the corner applicator previously described. Otherwise, use of the device is identical to that described for the embodiment of FIGS. 1, 1A.

Just as FIGS. 2, 2A showed an alternative arrangement to the one described for FIGS. 1, 1A, it would be possible to use the same principles for a straight-joint tape applicator as described above. In this case the blade member would be wider and the V-shaped rubber element would be replaced by a straight-edged element. Again, operation would be essentially the same as described above for the FIGS. 2, 2A embodiment.

Refinements in the applicator as previously described have been effected to make it lighter in weight and easier to use, especially with respect to the tape cutting feature and the aspect of interchangability of the guide and applicator rollers. While the refined applicator may appear to be quite different from the basic applicator, the operating principles thereof are essentially the same and there has been no significant departure from the basic invention.

Figure 10:
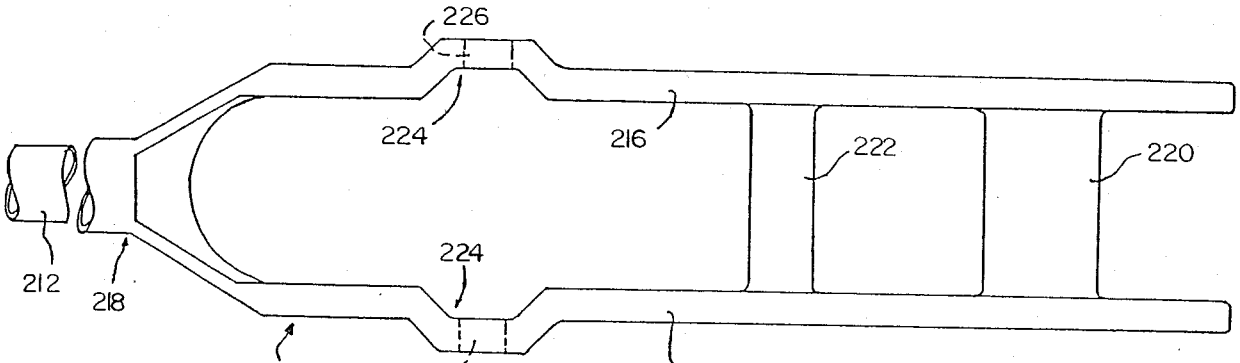
FIG. 10 shows a plan view of the head member of this embodiment of the invention.
Figure 11:
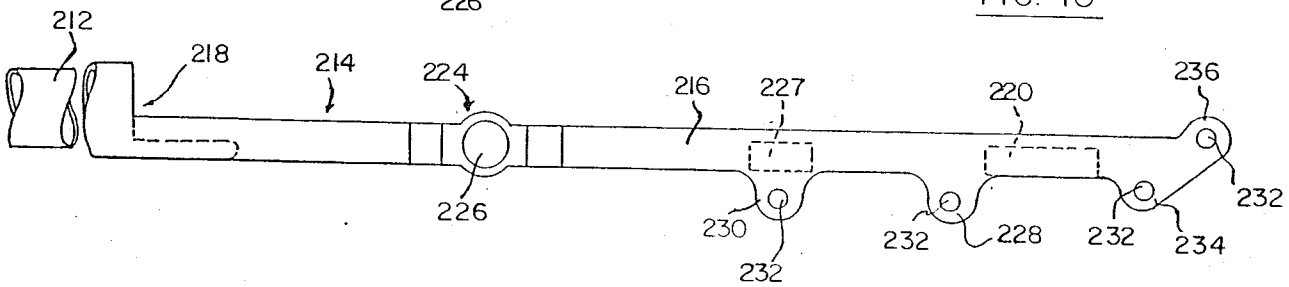
FIG. 11 shows an elevational view of the head member of FIG. 10.

This latest embodiment of the invention will be described hereinafter, having due regard to the drawings wherein:

FIGS. 10 and 11 show the head member 214 of another alternative embodiment, which member is attachable to an elongated cylindrical or tubular handle 212 as with the embodiment of FIG. 1. The head member 214 includes a pair of side walls 216 which are considerably narrower than the side walls 36 of the first embodiment, being only about $\frac{3}{8}$ inch in height. The head member is integrally cast from a lightweight material such as aluminum and includes end sections 218,220 interconnecting the side walls, along with an intermediate interconnecting section 222. In fact the sections 220,222 take the form of rectangular webs positioned adjacent the lower edge of the side walls, and the end section 218 is enlarged for reception of the handle 212 in the same manner as with the first embodiment. Such manner of connection need not be described herein.

As with the first embodiment, the side walls 216 include outwardly offset sections 224 each provided with a through bore 226 for reception of a stub shaft 60 of a tape roll-holding disc member 54. The manner of mounting the disc members within the head member 214 is identical to that disclosed with respect to the first embodiment and need not be described herein.

A pair of lugs or ears 228,230 are integrally cast with the side walls so as to extend downwardly therefrom in the vicinity of the webs 220,222 respectively. Each ear has a bore 232 therethrough to receive the shaft of a tape guide roller, to be described hereinbelow. At the free end of the head member is a pair of longitudinally offset ears or lugs 234,236, the former extending below the side wall and the latter extending above the side wall. Each ear 234,236 has a bore 232 extending therethrough to receive the shaft of a tape guide roller.

Figure 12:
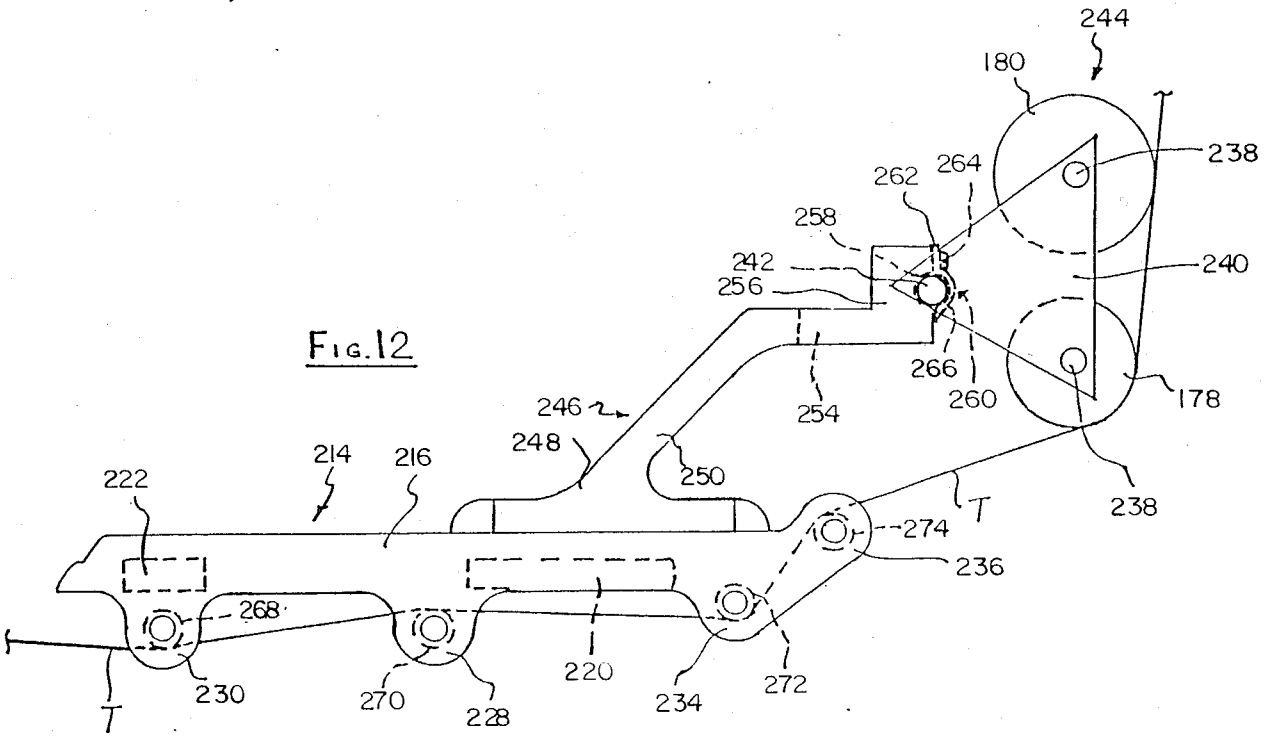
FIG. 12 shows an elevational view of the operational end of the head member of this embodiment, absent the cutting mechanism.
Figure 13:
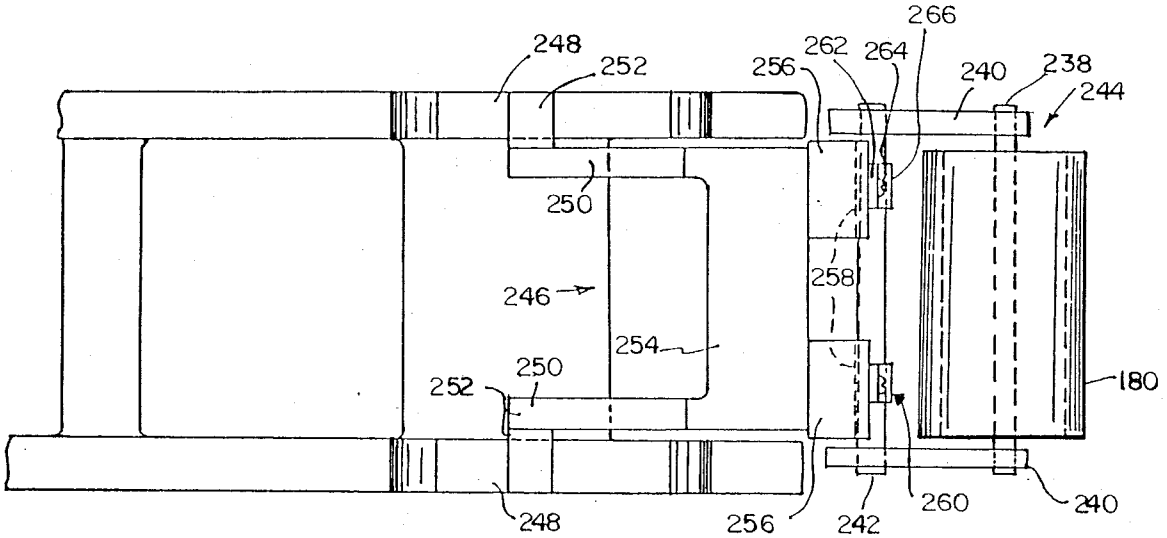
FIG. 13 is a plan view of the structure of FIG. 12.

FIGS. 12 and 13 show the free end of the head member 214 and illustrate the manner in which tape applicator rollers, such as the rollers 82,86 or 178,180 of the first embodiment, are mounted to the head member. In these figures a first cylindrical applicator roller 178 and a second cylindrical applicator roller 180, as would be used to apply drywall tape to a flat joint, are illustrated.

The rollers 178,180 are each mounted on a respective shaft 238 which shafts are located at two apices of a triangular carrier frame member 240. A pivot shaft 242 connects the frame members 240 at the other apex. Preferably the frame members 240 are permanently affixed to the three shafts 238,238,242 with the rollers 178,180 journaled on their respective shafts 238 for rotation thereon. Alternatively the rollers could be affixed to the respective shaft 238 which in turn could be journaled for rotation in appropriate bores in the frame members 240.

The frame member 240, rollers 82,86 or 178,180 and the appropriate shafts define a roller carrier 244. The roller carrier is supported above and forwardly of the free end of the head member 214 by a carrier support 246. The carrier support may be an integrally cast unit which may then be bolted or otherwise secured to the upper edge of the head member.

The carrier support 246 includes a pair of elongated foot portions 248 spaced apart by an amount sufficient to permit each to rest on the top of a respective side wall 216. A forwardly inclined leg portion 250 projects upwardly from each base portion 248 and is offset inwardly from its base portion by a connecting portion 252. At their uppermost ends the arms extend forwardly, beyond the ears 236 and parallel to the side walls 216, the extensions of the arms being laterally interconnected by a web 254. A pair of enlarged lugs 256 are integrally formed at the forward edge of the web 254, each lug projecting above the web and forwardly thereof. The front vertical face of each lug has a transversely extending semicircular bearing recess 258 therein, adapted to receive a portion of the pivot shaft 242 of the roller carrier therein.

The shaft 242 is held in the recesses 258 by clips 260, there being one on each lug 256. Each clip 260 includes a flat portion 262 which lies against the front face of the lug and through which a machine screw or bolt 264 passes to connect the clip 260 to the lug 256. The clip also has a sprung, curved portion 266 which passes over the shaft 242 and applies an inwardly directed force thereagainst. The clip provides two main functions: (1) it holds the shaft 242 in the recess 258 thereby securing the carrier frame 244 to the applicator; and (2) it applies a frictional retention force to the shaft such that the force prevents unwanted pivotting movement of the carrier frame. The frictional force applied by the clips is not sufficient to prevent pivotting movement of the carrier frame when the applicator is in use.

FIG. 12 also shows the path taken by the tape as it is fed from a roll of tape (not shown) held between the side walls 216 by the disc members 54. The tape T is taken from the roll and passes under a first guide roller 268 which extends between the ears 230 and is journaled on a shaft supported in the bores 232. The tape then passes over a second guide roller 270 which extends between the ears 228, under a third guide roller 272 which extends between the ears 234 and over a fourth guide roller 274 which extends between the ears 236. The tape is then brought forwardly to pass around the first applicator roller 178 to the second applicator roller 180.

Figure 16:
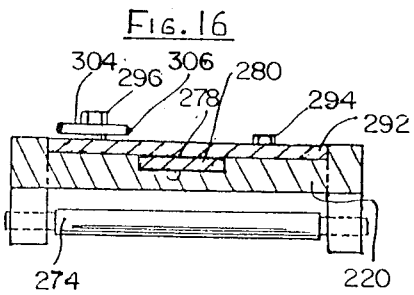
FIG. 16 is a cross-sectional view on the line 16—16 of FIG. 15.
Figure 15:
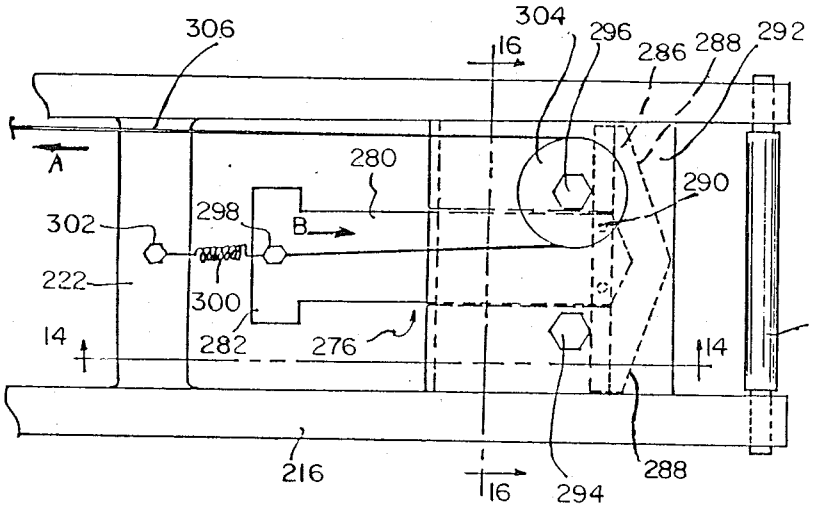
FIG. 15 is a plan view of the operational end of this embodiment showing the cutting mechanism, absent the first applicator rollers.
Figure 14:
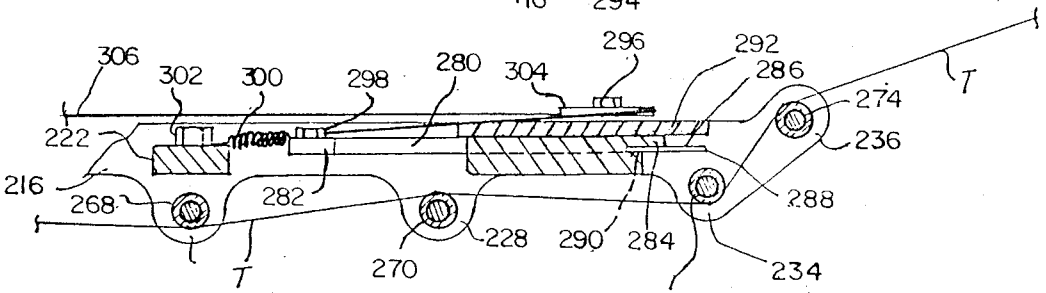
FIG. 14 is a cross-sectional view on the line 14—14 of FIG. 15, showing details of the cutting mechanism.

FIGS. 14, 15 and 16 show the cutter assembly 276 as used with this embodiment. While the cutter mechanism of the first embodiment may be considered as being "active", in that the cutting blade is projected forwardly by spring force, the mechanism of this embodiment may be considered as being "passive", requiring the operator to provide the necessary cutting motion, as will be seen hereinafter.

With reference first of all of FIG. 16 it will be seen that the interconnecting web 220 is provided with a central groove 278 located in the upper portion thereof. The groove 278 is intended to guide and support a cutting blade shank 280 which has a main body section received in the groove 276 and a laterally enlarged head portion 282, seen in FIG. 15. The forward end of the shank is recessed on the bottom as at 284 to receive a cutting blade 286. The blade 286 has angled cutting edges 288 and extends the width of the opening between side walls 216. The blade may be attached to the shank by machine screws 290, thereby facilitating replacement of the blade when it becomes dull.

The shank is secured within the groove 278 by a top plate 292 which is bolted to the web 220 by bolts 294,296. The plate overlies the front and rear edges of the web, to thereby guide the shank more effectively and, at the front, to cover the sharp edges 288 of the blade 286 and thus protect an operator from inadvertently cutting himself as he grasps the tape T at the free end of the head.

At the rear end of the shank 280 a central bolt 298 secures one end of a tension spring 300 to the shank 280. The other end of the spring 300 is attached to the intermediate web 222 by a bolt 302.

The bolt 296 which is used to attach the plate 292 to the web 220 also carries a pulley 304 which can rotate thereon. The pulley 304 is located parallel to and just above the plate 292. A flexible cable 306 is attached at one end to the bolt 298 at the rear end of the shank, passes around the pulley 304 and then extends back along the head member and the handle to be connected at its other end to the trigger 24. Suitable guides, not shown, may be used to ensure that the cable 306 passes from one end of the applicator to the other without interference. The cable may be of any suitable construction as long as it is flexible and exhibits negligible stretch under tension. For example aircraft wire may be used as may braided or woven cords such as might be used on drafting tables.

Operation of the cutting mechanism is readily apparent from FIGS. 14 and 15. During the application of tape to a drywall joint the tape T is fed as shown in FIG. 14, running from left to right in the figure. When the operator approaches the end of the joint he pulls on the trigger 24, thereby pulling on the cable 306 (arrow A, FIG. 15). That pull is transmitted around the pulley 306 to the rear end of the shank 280 and the shank is moved to the right, against the spring 300 (arrow B, FIG. 15). As the shank 280 moves to the right the blade edges 288 will encounter, and cut, the tape T between the guide rollers 272,274. The released free end of the tape may then be applied to the joint through continued movement of the applicator and the operator can simultaneously release the trigger so that the spring 300 retracts the shank 280 and the attached blade 286 to its retracted or safety position.

When the tape has been cut as described above the free end of the supply roll will hang loosely between the guide rollers 270,272. The operator can then pull the tape and thread it around the rollers 272,274 and then around the applicator rollers so that he can start to apply tape to another joint.

In the event that the operator wishes to apply tape to a corner joint after having applied tape to a number of flat joints, or vice versa, he can undo the screws 264 holding the clips 260 to the carrier frame 246 to thereafter remove the frame assembly 244 carrying the applicators rollers he has been using. He can replace that assembly with another assembly carrying the applicator rollers appropriate to the style of joint to be taped. Thus, a single applicator can be used to tape both flat and corner joints.

Figure 17:
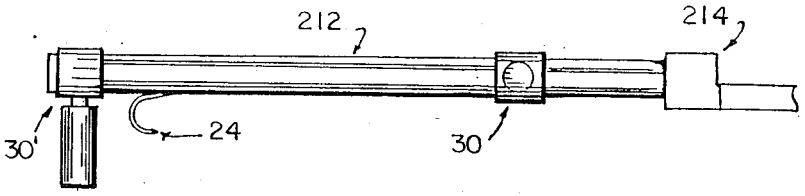
FIGS. 17 and 17A show elevation and plan views respectively of the handle of the application of this embodiment.
Figure 17A:
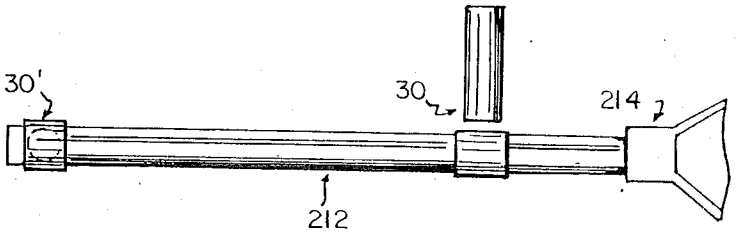

The last improvement over the applicator of the first embodiment is seen in FIGS. 17 and 17A, wherein it is seen that the handle 212 is straight over its entire length. An auxiliary handle assembly 30 is still used, slidingly and rotatably adjustable on the handle for the convenience of the operator. However, instead of the angled end portion of the first embodiment this embodiment uses a second adjustable handle assembly 30' at the free end of the handle. This gives the operator more room to achieve a comfortable working relationship for his hands, and furthermore, by having both handle assemblies 30,30' removable from the main handle 212, the applicator is easier to disassemble for packaging or storage.

Finally, it should be understood that while the applicator disclosed herein has been described with particular regard to drywall tape and drywall joints it is not limited to that use alone. Other types of tapes such as packaging tapes, seaming tapes and carpet tapes for example, could be applied using the applicator of this invention and undoubtedly other applications for the invention would become obvious to a skilled workman. Also, while several variations on the theme of the present invention have been disclosed it is expected that skilled workmen in the art could alter the structure of the invention without departing from the spirit thereof. Thus, the protection to be afforded the present invention is to be determined from the claims appended hereto.

I claim:

1. A method of applying adhesive-backed drywall tape to a corner joint using a tape applicator having a head portion and a handle portion, the head portion including tape mounting means and a roller assembly having first and second applicator rollers thereon, said assembly being pivotable between upper and lower limit positions, said second applicator roller having a V-shaped surface profile, said first applicator roller being about half the width of said tape, and said head portion including latch means to hold said assembly in the lower limit position, the method comprising the steps of:

(a) loading a roll of drywall tape into said tape mounting means;

(b) snagging the free end of said tape on a serrated edge of a tape cutter adjacent said second applicator roller with said assembly latched in said lower limit position, with tape contacting said applicator rollers;

(c) orienting said applicator to place the tape adjacent said applicator rollers into the corner at one end thereof, the profile of each of said applicator rollers applying a setting pressure to the tape to force it into said corner;

(d) releasing said latch means;

(e) drawing said applicator along said corner, keeping said second applicator roller in the corner, and applying tape drawn from the tape roll to the corner-defining wall surfaces;

(f) when the corner has been taped, withdrawing said applicator from the corner, thereby permitting said assembly to return to its lower limit position under a spring bias where at it is held by said latch means, leaving a short length of tape between the corner and the applicator; and (g) moving said applicator sharply downwards to sever said short length of tape by said serrated edge.

2. A method of applying adhesive-backed drywall tape to a corner joint defined by adjacent sheets of drywall material using a tape applicator having a head portion and a handle portion, the head portion including tape mounting means, a pivotable roller assembly having a cylindrical first applicator roller and a V-shaped second applicator roller therein, and trigger-operated tape cutting means, the method comprising the steps of:

(a) loading a roll of drywall tape into said tape mounting means;

(b) feeding the free end of said tape across guide means towards said roller assembly and then about said first and second applicator rollers, said roller assembly having been rotated to a rotational limit position thereof;

(c) orienting said applicator to place the tape adjacent said applicator rollers at one end of said joint;

(d) drawing said applicator along said joint, keeping said applicator rollers closely adjacent said drywall material, and applying tape drawn from the tape roll to the joint-defining drywall material by initially adhering tape to said material by the circumferential edges of said first applicator roller and thereafter stretching said tape into said corner with said V-shaped second applicator roller; and (e) when the joint has been taped, operating said trigger-operated cutting means to sever said tape adjacent the other end of the joint, release of the trigger of said cutting means permitting said cutting means to return to a safety position within said head member.

3. A device for applying adhesive-backed drywall tape to a joint defined by abutting drywall panels, comprising:

(a) a generally rectangular integrally formed head member having side and interconnecting end sections, said side and end sections defining a tape roll receiving opening in said head member;

(b) spring-biased tape roll mounting discs rotatably journalled within said opening, there being one such disc associated with each of siad side section;

(c) elongated handle means mounted to one of said head member end sections and including trigger means therein;

(d) a roller assembly including frame members pivotally mounted to the other of said head member end sections, a first applicator roller and a second applicator roller rotatably mounted between and to said frame members, and a tape cutter member mounted between and to said frame members adjacent said applicator rollers;

(e) latch means mounted to said head member adjacent one rotational limit position of said roller assembly, said limit position being the position of said assembly at the start of a taping operation;

(f) means connecting said latch means to said trigger means; and (g) means biasing said roller assembly towards said one limit position.

4. An applicator for tape provided in a roll wound on a core, comprising:

(a) elongated handle means;

(b) a unitary head member including integrally formed side wall means and interconnecting end sections, said handle means being affixed to one of said end sections;

(c) a pair of axially aligned disc members positioned between said side wall means for frictionally engaging the ends of a tape roll core located therebetween, each disc member being affixed to a stub shaft rotatably journalled in the adjacent side wall means and being biased towards the interior of said head member;

(d) transversely spaced support means including a pair of N-shaped frame members each being pivotally attached at one apex thereof to an adjacent outer surface of the other of said head member end sections, said frame members each mounting one end of first and second tape applicator rollers respectively at the free ends of the two legs defining said one apex;

(e) each of said applicator rollers being as long as at least one half the width of the tape to be applied;

(f) means biasing said support means towards one rotational limit thereof; and (g) tape cutting means mounted between the third legs of said frame members for cutting said tape.

5. The applicator of claim 4 wherein said first applicator roller is cylindrical and said second applicator roller has a generally V-shaped surface profile, said applicator rollers being of equal width, about one half the width of the tape to be applied.

6. The applicator of claim 4 wherein said tape cutting means includes a cutting member having a serrated cutting edge.

7. The applicator of claim 4 including a latch mechanism for locking said support means at the one rotational limit position thereof, said latch mechanism including a latch member pivotally mounted to said head member adjacent said one limit position, said latch member having a cam face and a latch face thereon, said latch face being engageable with a flat provided on a shaft mounting said first applicator roller and being releasable therefrom by operation of said trigger means.

8. The applicator of claim 4 including a resilient guide member projecting away from said cutting member adjacent the free ends of said third legs, said guide member having side edges generally defining a right angle therebetween.

9. A device for applying adhesive-backed drywall tape provided in a roll wound on a core, to an interior corner defined by meeting panels of drywall material comprising:

(a) elongated handle means;

(b) a unitary head member including integrally formed side wall means and interconnecting end sections, said handle means being affixed to one of said end sections;

(c) a pair of axially aligned disc members positioned between said side wall means for frictionally engaging the ends of a tape roll core located therebetween, each disc member being affixed to a stub shaft rotatably journaled in the adjacent side wall means and being biased towards the interior of said head member;

(d) transversely spaced carrier means pivotally mounted to the other of said head member end sections;

(e) a generally cylindrical first applicator roller rotatably supported between said carrier means, said first applicator roller having a width about one half the width of the tape to be applied and adapted to apply said tape only along lines defined by the outer circumferential edges thereof to the drywall panels defining said corner;

(f) a second applicator roller rotatably supported between said carrier means, having a V-shaped surface profile and the same width as said first applicator roller and being adapted to stretch the tape initially applied by said first applicator roller into said corner for adherence to said panels; and (g) tape cutting means operable to cut said tape.

10. The applicator of claim 9 including carrier support frame means projecting upwardly and forwardly from said other head member end section for povitally supporting said carrier means above and outwardly of the free end of said other end section.

11. The applicator of claim 10 wherein said carrier means includes a pair of generally triangular frame members spaced apart by a pivot shaft passing through one apex thereof, said shaft being pivotally carried by and removable from said carrier support frame means, and said frame members rotatably mounting therebetween said applicator rollers, one at each of the other two apices of the triangular frame members.

12. The applicator of claim 11 wherein said carrier support frame means includes a pair of forwardly facing end faces, each with a semi-circular recess therein for reception of a corresponding end of siad pivot shaft, and wherein removable clamp means are attached to each end face for clamping the appropriate pivot shaft end into the adjacent recess and for imposing a force thereon so as to frictionally inhibit free rotation of said shaft and said triangular frame members attached thereto.

13. The applicator of claim 11 including ear means projecting below each of said side wall means for supporting tape guide means extending across said head member, said guide means serving to direct tape from said roll to said applicator rollers.

14. The applicator of claim 9 wherein said cutting means includes a generally triangular cutting blade, an elongated, planar blade carrier reciprocably located between said side wall means adjacent said other end section; means for guiding said blade carrier; anchor means extending between said side wall means; spring means connecting said anchor means to said blade carrier; and flexible means connecting said blade carrier to trigger means adjacent the free end of said handle means; whereby operation of said trigger means will move said blade carrier from a retracted safety position within said other end section to a projected position in which said cutting blade can sever said tape, and release of said trigger means will permit said spring means to retract said blade carrier from said projected position to said retracted safety position.

15. The applicator of claim 14 wherein said trigger means includes a trigger member slidably mounted to said handle means and said flexible means includes a cable connected at one end thereof to said trigger member, said cable extending along said handle means and said head member to and around a rotatable pulley member adjacent said other end section, and being connected at its other end to said blade carrier adjacent the innermost end thereof.

16. The applicator of claim 15 wherein said pulley member is parallel to said blade carrier.

17. The applicator of claim 15 wherein said cable is formed from fine aircraft wire.

18. The applicator of claim 15 wherein said cable is formed from braided or woven cord.

19. The applicator of claim 9 including main and auxiliary holding means adjustably mounted on said handle means, each including a generally annular collar closely fitting on said handle means for sliding and rotating movement thereon, a radially extending threaded bore through the collar, a plug received in the bore adjacent the handle means, and a grip member having a threaded rod projecting therefrom for threaded engagement with the bore to thereby lock the plug against said handle means and thus prevent movement of the holding means relative to said handle means.

20. The applicator of claim 19 wherein said main holding means is to be located at the free end of said handle means and said auxiliary holding means is to be located between said main holding means and said head member.

21. A roller assembly pivotably connectable to a tape applicator device for applying adhesive-backed drywall tape to a corner defined by meeting drywall panels, comprising:

a pair of generally triangular spaced spart carrier members;

a first axle connecting said members together adjacent a first apex thereof and adapted for pivotable connection to said device;

a generally cylindrical applicator roller rotatably mounted between said members adjacent a second apex thereof; and a V-shaped applicator roller rotatably mounted between said members adjacent the third apex thereof, said applicator rollers having the same width and each being about one half the width of the tape to be applied, said cylindrical roller being adapted to contact the tape only along the outer circumferential edges thereof and said V-shaped roller being adapted to contact the tape only on the V-shaped surface thereof.

* * * * *